United States Patent [19]

Paddock et al.

[11] 4,342,194

[45] Aug. 3, 1982

[54] ELECTRIC AIR CONTROL SWITCHING VALVE

[75] Inventors: Gordon R. Paddock; John E. Jones, both of Rochester, N.Y.

[73] Assignee: General Motors Corporation, Detroit, Mich.

[21] Appl. No.: 192,725

[22] Filed: Oct. 1, 1980

[51] Int. Cl.[3] ..... F01N 3/22

[52] U.S. Cl. ..... 60/290; 60/284; 60/306; 137/625.42; 137/625.48

[58] Field of Search ..... 60/289, 290, 284, 306; 137/625.42, 625.48

[56] References Cited

U.S. PATENT DOCUMENTS

| | | | |
|---|---|---|---|
| 3,662,540 | 5/1972 | Murphey | 60/30 R |
| 3,835,646 | 9/1974 | Ranft et al. | 60/290 |
| 3,906,723 | 9/1975 | Matumoto | 60/290 |
| 3,919,842 | 11/1975 | Bolton | 60/289 |
| 4,070,830 | 1/1978 | Beiswenger | 60/290 |
| 4,077,208 | 3/1978 | Sawada | 60/290 |
| 4,174,610 | 11/1979 | Hollis | 60/290 |
| 4,177,642 | 12/1979 | Klimazewski | 60/290 |
| 4,178,755 | 12/1979 | Klimazewski | 60/290 |

FOREIGN PATENT DOCUMENTS

| | | | |
|---|---|---|---|
| 52-11323 | 1/1977 | Japan | 60/290 |

*Primary Examiner*—Douglas Hart
*Attorney, Agent, or Firm*—Arthur N. Krein

[57] ABSTRACT

An electric air control switching valve for use in controlling the delivery of secondary air from an engine driven air pump selectively, as a function of both engine operation and the operation of its associated emission control system, to either the exhaust manifold of an engine, preferably at a location closely adjacent to the exhaust ports of the engine, during low temperature engine operation, to the atmosphere, as at the dirty side of the air cleaner associated with the induction system of the engine, during low temperature engine deceleration, to a converter in the exhaust system for the engine downstream of the exhaust manifold during normal engine operation, or again to the atmosphere, as at the dirty side of the air cleaner, when the converter temperature exceeds a predetermined temperature.

4 Claims, 1 Drawing Figure

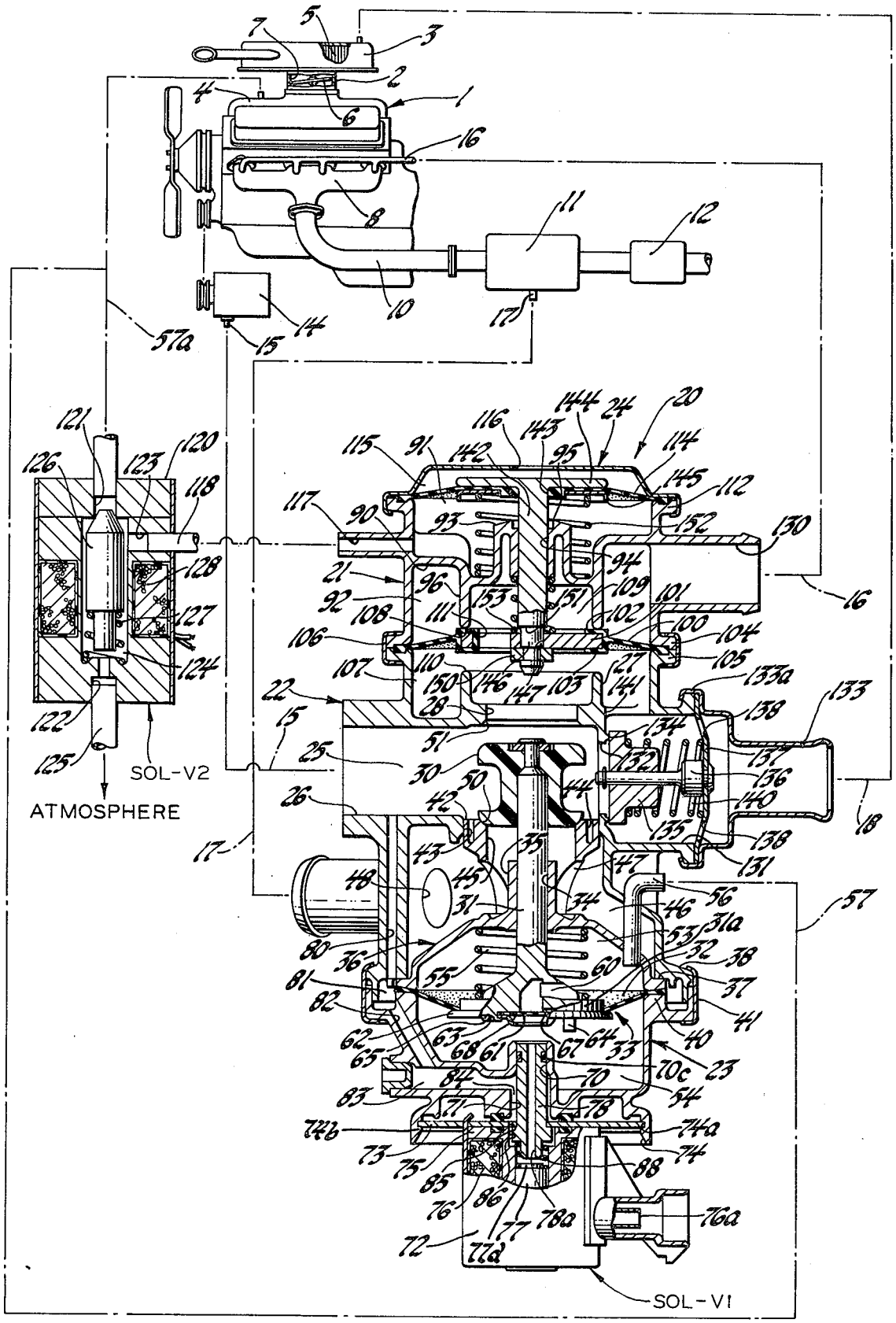
SOL-V2
ATMOSPHERE
SOL-V1

ELECTRIC AIR CONTROL SWITCHING VALVE

FIELD OF THE INVENTION

This invention relates to an air flow control valve for use in a system which delivers secondary air from an air pump to the exhaust system of an internal combustion engine and, in particular, to an electric air control switching valve for selectively switching the flow of secondary air to either the exhaust manifold, the converter, or to the atmosphere, all as a function of engine operation and converter temperature.

DESCRIPTION OF THE PRIOR ART

It has been found in internal combustion engine emission control systems of the type which includes an air induction device for introducing secondary air into the exhaust system either at the exhaust manifold or into a converter of the system that, for efficient and trouble free operation, it is necessary that the delivery of secondary air either to the exhaust manifold or to the converter be suitably controlled as a function of engine operation, during certain modes of operation and that, at other times, this secondary air should be diverted back to the atmosphere.

Suitable air control valves used alone or in combination with other valves have been used to provide for one or more of the above-described functions but no air control valves are known which are operative so as to perform all of the above-described functions in direct response to both engine operation and converter temperatures.

SUMMARY OF THE INVENTION

It is therefore a primary object of this invention to provide an improved electric air control switching valve for use in an exhaust emission control system for controlling the delivery of secondary air from an air pump selectively, as a function of engine operation and converter temperature to either the exhaust manifold of the engine, to a converter in the exhaust system downstream of the exhaust manifold or to the atmosphere.

Another object of this invention is to provide an electric air control switching valve for use in the exhaust emission control system of an internal combustion engine that is operative to direct secondary air to the exhaust manifold during low temperature engine operation, to the atmosphere during low temperature engine deceleration, to the converter during normal engine operation, and to the atmosphere during operation of the converter above a predetermined temperature.

These and other objects of the invention are attained by means of an electric air control switching valve that, in effect, is a combination of an electric air diverter valve and an electric air switching valve in unit assembly with each other.

For a better understanding of the invention as well as other objects and further features thereof, reference is had to the following detailed description of the invention to be read in connection with the accompanying drawing.

DESCRIPTION OF THE DRAWING

The drawing is a schematic view of an internal combustion engine having an air pump for delivering secondary air to the exhaust system of the engine and having incorporated therein an electric air control switching valve in accordance with a preferred embodiment of the invention, this valve assembly being shown in a cross-sectional elevational view and disposed between the air pump and the exhaust system, with elements of the valve assembly being shown in their respective position when no vacuum signal is applied to any of the differential pressure operated actuators thereof.

DESCRIPTION OF THE PREFERRED EMBODIMENT

Referring to the drawing, there is shown an internal combustion engine 1 provided, for example, with a carburetor 2 and an air cleaner 3 mounted thereon for supplying induction fluid to the intake manifold 4 of the engine. In a conventional manner, air cleaner 3 has an annular air filter 5 mounted therein. Primary air flow through the carburetor 2 to the engine 1 is controlled by a throttle valve 6 pivotable within the induction passage 7 extending through the carburetor. An exhaust manifold 8 receives the exhaust gases discharged through the exhaust ports, not shown, from the cylinders, not shown, of the engine and defines a flow path for the combustible exhaust gases discharged therefrom. Each exhaust manifold 8 is suitably connected to an exhaust pipe 10 which, in turn, is connected to, for example, a dual-bed catalytic converter 11 and a muffler 12.

A suitable air pump, such as an engine driven air pump 14, delivers clean secondary air via a conduit 15 to an electric air control switching valve, generally designated 20, in accordance with a preferred embodiment of the invention, which is operative in a manner to be described to effect delivery of secondary air either through a conduit 16 to the exhaust manifold 8, through a conduit 17 to the converter, as by having conduit 17 connected to the converter immediately upstream of the second bed, not shown, therein, or, by a conduit 18 to the atmosphere, as by having conduit 18 connected to the air cleaner 3 for discharge thereinto on the dirty side of the air filter 5 therein.

The electric air control switching valve 20, in the construction illustrated, includes a multiple piece housing having as major elements thereof an upper body 21, an intermediate body 22, a lower body 23 and, an upper cup-shaped cover 24, with these elements being suitably secured together in a manner to be described hereinafter.

The intermediate body 22 is formed with a central stepped opening extending upward from the lower portion thereof to provide a central valve chamber 25 adjacent to the upper end of the intermediate body. Intermediate body 22 is provided with a lateral inlet passage 26 that extends through a side wall thereof and which is adapted to be connected at one end to the conduit 15 and which has its other end opening into the valve chamber 25. The upper end wall of the intermediate body is provided with an upstanding boss 27 having a stepped bore therethrough defining a primary outlet passage 28 from the valve chamber 25.

A valve member 30 is movably positioned in the valve chamber 25 and is suitably secured to the upper end of a valve stem 31. The lower end of valve stem 31 is suitably secured to the diaphragm 32 of a switching diaphragm assembly, generally designated 33. The valve stem 31 is sealingly guided for reciprocable movement in a valve stem guide bore 34 provided for this purpose in the central guide portion 35 of an insert member 36.

Insert member 36 is secured about its lower rim 37, together with the outer peripheral edge of the diaphragm 32, between the lower rim 38 of the intermediate body 22 and the upper flange 40 of the lower body 23, these elements being suitably secured together, as by a band clamp 41. The upper rim 42 of insert member 36 is pressed into the cylindrical internal bore wall 43 of intermediate body 22, a deep annular groove 44 in the upper rim 42 facilitating this press fit.

Insert member 36 has a cylindrical recess extending from the top thereof concentric with the guide bore 35 to provide a vertical passage 45 which having one end thereof in communication with the valve chamber 25. Insert member 36, as thus positioned in the intermediate body 22, forms with the internal of the lower portion of the intermediate body an annular chamber 46 which is in communication with the passage 45 by means of openings 47 through the outer annular wall of the insert member 36.

A lateral extending converter outlet passage 48 is provided in the intermediate body 22 with one end of this converter outlet passage opening into the chamber 36 while its opposite end is adapted to be connected by the conduit 17 to the converter 11. The converter outlet passage 48, chamber 46, openings 47 and passage 45 form, in effect, the converter discharge passage of the valve assembly 20.

The upper periphery of the insert member 36 surrounding passage 45 defines a lower valve seat 50 which is engageable by the valve member 30 and, which is positioned in a co-axially separated relationship to an upper valve seat 51 surrounding the lower end of the vertically aligned primary outlet passage 28.

The switching diaphragm 32 forms with the lower cup-shaped end of the insert member 36, in intermediate body 22, a vacuum chamber 53 and, with the dish-shaped lower body 23 an actuator chamber 54.

The vacuum chamber 53 has a coiled metering spring 55 positioned therein so as to encircle the valve stem 31. One end of the metering spring 55 abuts against the lower wall of insert member 36 while the opposite end of this spring abuts against the lower flanged end **31*a* of the valve stem 31. With this arrangement, the valve member 30 is normally biased into seating engagement against the valve seat 50 to thereby block flow of secondary air from chamber 25 out through the passage 45**.

The vacuum chamber 53 is connected by a fitting 56 and by a conduit 57 to a source of engine vacuum, such as by being connected to the intake manifold 4 downstream of the throttle valve 6. As shown, fitting 56, in the construction illustrated, extends through a wall of intermediate body 22 and the radial wall of insert member 36 so that one end thereof opens into vacuum chamber 53 and its other end is positioned for connection to conduit 57 in a conventional manner.

Valve stem 31 has a passage 60 therein used to connect the vacuum chamber 53 in flow communication with the actuator chamber 54, a flat type, flapper check valve 61 being disposed to regulate flow through the passage 60 in one direction. A diaphragm retainer 62 in the form of a circular washer is positioned under diaphragm 32 and it is provided with a plurality of apertures 63 which received the alignment pins 64 formed on the lower enlarged flange portion of the valve stem 31. A number of these alignment pins 64 are riveted as at 65 to secure the diaphragm retainer 62 to the valve stem 31 with the inner peripheral rim of the diaphragm 32 sandwiched therebetween. The outer rim of the check valve 61 is loosely supported by the the inner rim of the diaphragm retainer 62.

The flapper check valve 61 is provided with a central flat portion which is positioned so as to overlie an annular valve seat 68 formed on the lower end of the valve stem 31 to encircle the lower end of passage 60. A timing orifice, in the form of a radial notch 67, is coined in the valve seat 68.

During the period when manifold vacuum in vacuum chamber 53 is increasing, flow between the actuator chamber 54 and vacuum chamber 53 through passage 60 is restricted with flow occuring only through the timing orifice notch 67. Thus, the volume of the actuator chamber 54 and the size of the timing orifice notch 67 determine the timing required for the pressure in these chambers 53, 54 to be equalized sufficiently whereby the spring 55 will move the diaphragm 32 to the position shown whereby valve member 30 is positioned so as to block flow through passage 45. During a period of increasing pressure in vacuum chamber 53, the central flap of the flapper check valve 61 will be pushed downwardly so as to become unseated relative to valve seat 68 to thus allow unrestricted flow from the vacuum chamber 53 to the chamber 54 to again allow the spring 55 to move the diaphragm 32 to the position shown.

Switching diaphragm assembly 33 is thus similar in construction to the switching diaphragm assembly of the air flow control unit disclosed in U.S. Pat. No. 3,835,646 issued Sept. 17, 1974 to Ernst L. Ranft, Gordon R. Paddock and Jeremiah J. Murray, the disclosure of which is incorporated herein by reference thereto.

In addition, in the subject valve assembly, the actuator chamber 54 is also adapted to be supplied with an actuator fluid, such as pressurized air, with flow of this fluid to the actuator chamber being controlled by a solenoid valve SOL-V1.

For this purpose, in the embodiment illustrated, the lower body 23 is provided with a stepped bore therethrough to define an upper cylindrical internal wall 70 and a lower cylindrical wall 71 with wall 70 being of reduced diameter relative to wall 71. The solenoid valve SOL-V1, in the construction shown, includes a cylindrical housing 72 that is suitably fixed at one end to a circular support plate 73. Support plate 73, in turn, is suitably fixed within the depending annular wall 74 of lower body 23, as by being snapped past the annular lip **74*b* of this wall 74 whereby the support plate 73 is sandwiched between this lip 74*b* and an internal shoulder 74*a***.

Solenoid valve SOL-V1 further includes a tubular bobbin 75 positioned within the solenoid housing 72, the bobbin 75 being formed to support a solenoid coil 76. Solenoid coil 76, is adapted to be connected by suitable leads **76*a*, only one being shown, to a source of electrical power, as controlled, for example by an onboard electronic computer, not shown, which receives control signals indicative of engine temperature and also of the operating temperature of converter 11**, whereby the solenoid coil, in the embodiment shown, will be energized during cold start and will be normally deenergized during warm mode of engine operation, that is, after the engine has reached a predetermined operating temperature, but will be energized if the operating temperature of the converter exceeds a predetermined temperature.

A cylindrical armature 77 is slidably received in the bore of bobbin 75. A tubular solenoid pole piece 78, having an axial passage 78a therethrough is located through the upper wall 70, its outside periphery being sealed to 70 via an O-ring 70c, and is loosely received within the lower wall 71 for allowance of air flow through chamber 84 to inlet passage 85. As shown, the armature 77 is thus able to move between an open position with respect to the pole 78, the position shown, and a closed position at which the upper end of the armature 77 with a valve 77d thereon, would abut against the lower surface of pole 78, thus blocking fluid flow through passage 78a.

In the construction illustrated, the pressurized fluid is supplied to the actuator chamber 54 as controlled by the solenoid valve SOL-V1, by the air pump 14. For this purpose intermediate body 22 is provided in its outer peripheral wall with a vertical passage 80 opening at one end from inlet passage 26 and having its opposite end in flow communication with an annular grooved passage 81 formed in the upper rim 40 of lower body 23.

The grooved passage 81 is connected by an inclined passage 82 and by an intersecting horizontal passage 83, both suitably formed in lower body 23, to an annular supply chamber 84 provided between the outer peripheral surface of solenoid pole piece 78 and the internal lower wall 71. Supply chamber 84 is connected by a passage 85 extending through support plate 73 and an axial passage 86 in bobbin 75 to an annular chamber surrounding the lower reduced diameter end of the pole 78 that is in flow communication with the axial passage 78a of pole 78 when the latter is in its raised or open position shown. The armature valve 77 is normally biased to this open position by a coil spring 88 abutting at one end against the fixed pole 78 and at its other end against the armature valve.

Referring now to the upper body 21, it is provided with an internal web 90 which divides the interior of the upper body 21 into an upper compartment 91 and a lower compartment 92. Web 90 is provided with a central upstanding boss 93 that extends into upper compartment 91 and which is formed with a through valve stem guide bore 94 and with an annular valve seat 95 at its free end encircling the guide bore 94. Web 90 is also provided with a depending tubular boss 96 extending downward into the lower compartment 92, the boss 96 being located concentric with the boss 93 and therefor with the guide bore 94.

A flexible diaphragm valve means 100 carrying a circular flat disc-like, valve element 101 providing opposed annular valve seats 102 and 103, is secured between the upper body 21 and the intermediate body 22. In the construction shown, the outer peripheral portion of the diaphragm valve means 100 is sandwiched between the lower flange 104 of upper body 21 and the upper flange 105 of intermediate body 22, a band clamp 106 being used to secure these elements together.

The diaphragm valve means 100 forms with the upper interior of the intermediate body 22, an annular chamber 107 and separates this chamber from the lower compartment 92 of upper body 21. The valve element 101, as part of the flexible diaphragm valve means 100, is thus adapted for movement between a first position at which its upper valve seat 102 engages the annular upper valve seat 108 defined by the lower annular edge surface of tubular boss 96, and a second position at which its lower valve seat 103 engages the lower valve seat 110 on the upper edge surface of boss 27 encircling the outlet passage 28. Valve element 101 is provided with a plurality of through openings 111, only one being shown in the drawing, that are formed radially inward of the valve seats 102 and 103 and radially outward of the center, apertured support portion thereof. When valve element 101 is seated against valve seat 108, as shown, it forms with the interior of boss 96 a blind chamber 109.

Upper cover 24 is suitably secured to the upper flange 112 of upper body 21 with a flexible diaphragm actuator 114 sandwiched therebetween. Diaphragm actuator 114 defines an atmospheric chamber 115 with the upper cover 24 which is open to the atmosphere, as by the aperture 116 in the upper cover 24, and the diaphragm actuator separates this atmospheric chamber 115 from the upper compartment 91.

A port passage 117 provided in the upper body 21 opens at one end into the upper compartment 91 and is connected by a conduit 118 to a suitable solenoid valve, generally designated SOL-V2, which is used to control the application of a vacuum signal or an atmospheric pressure signal to the upper compartment 91. Accordingly the upper compartment 91 will hereinafter be referred to as a variable pressure chamber 91.

Solenoid valve SOL-V2, shown schematically, would be of conventional construction so as to include a valve body 120 having opposed axially aligned passages 121 and 122 and a lateral side passage 123, each of these passages at one end thereof opening into an annular chamber 124 provided in the interior of valve body 120.

As shown, passage 121 is adapted to be connected by a branch 57a of conduit 57 to receive a vacuum signal from the engine 1 at a location downstream of the throttle valve 6. Passage 122 is connected, for example, by conduit 125 to a source of clean air at atmospheric pressure. Passage 123 is connected by conduit 118 to the port passage 117 of the subject valve assembly.

An armature valve 126 is movably positioned in the chamber 124 relative to a pole, not shown, for movement between a first position blocking flow through the passage 121, while permitting flow between the passages 122 and 123, the position shown, and a second position at which the armature valve 126 blocks flow through passage 122 while permitting flow communication between passages 121 and 123. As shown, the armature valve 126 is normally biased to the first position by means of a coiled spring 127 and, in a conventional manner, can be moved to the second position upon energization of the solenoid coil 128.

The solenoid coil 128 is adapted to be connected to a source of electrical power, not shown, as controlled for example by an onboard electronic computer, not shown, which is adapted to receive a signal indicative of the engine operating temperature. It is not deemed necessary to describe such temperature sensing signal devices or to describe such an onboard electronic computer since they form no part of the subject invention and a description thereof is not deemed required for an understanding of the subject invention.

In the embodiment illustrated, the solenoid coil 128 of solenoid valve SOL-V2, upon the startup of engine operation would be energized and remain so until such time as the engine warms up to some predetermined temperature (which coincides with the point at which the converter 11 has reached a predetermined operating temperature). After such temperatures are reached, the solenoid coil 128 would be de-energized and would remain de-energized through engine shut down.

As shown, the upper body 21 is provided with an exhaust outlet passage 130 that commutes at one end with the chamber 92 and which at its other end is connected by conduit 16 to the exhaust manifold 8.

Intermediate body 22 has a pressure relief passage 131 extending from a lateral opening 132 disposed on one side of valve chamber 25 diametrically opposite inlet passage 26. Pressure relief passage 131 is adapted to be connected by a tubular fitting 133 to the conduit 18 whereby diverted and relieved secondary air can be returned to the atmosphere, that is, in the construction illustrated, to the dirty side of air cleaner 5.

A valve seat 134 is formed about opening 132 and it is engaged by a valve member 135. Valve member 135 is adapted to slide on a shaft 136 which is fixed at one end on a disc-like support member 137. Support member 137, in the embodiment shown, is secured by a spun over portion 133*a* of fitting 133 to the flanged end of the intermediate body 22. The support member 137, as shown, is provided with a plurality of circumferentially spaced apart through apertures 138 to effect flow communication from pressure relief passage 131 to the interior of fitting 133.

A spring 140 biases valve member 135 against the valve seat 134 until the pressure in valve chamber 25 rises above a preselected level. At this preselected pressure level, valve member 135 is displaced in an opening direction relative to the valve seat 134 whereby a portion of the secondary air flowing into the valve chamber 25, as supplied by air pump 14, is diverted through opening 132 and the pressure relief passage 131 for discharge to the atmosphere.

The intermediate body 22 is also provided with a passage 141 for effecting flow communication between the chamber 107 and the pressure relief passage 131, the passage 141 being located downstream of the valve seat 134.

The diaphragm actuator 114 is operatively connected to the diaphragm valve means by means of a valve stem 142 that is slidably received in the guide bore 94 provided in the upper body 21. As shown diaphragm actuator 114 is provided with a central aperture 143 to receive the stem portion of valve stem 142 and is fixed thereto as by being sandwiched between the flange 144 at the upper end of the valve stem 142 and a circular, centrally apertured spring retainer plate 145.

Valve stem 142 at its opposite end is provided with a reduced diameter portion 146 that slidably extends through a central aperture 147 in valve element 101. Axial movement of the valve stem 142 relative to the valve element 101 being limited in one direction by means of a washer-like abutment ring 150 suitably secured to the lower end of the valve stem 142. Axial movement of the valve stem 142 relative to valve element 101 in the opposite direction being limited by means of an abutment shoulder 151 provided on the valve stem 142 at a predetermined axial distance from the abutment ring 150 so as to permit limited axial movement of the valve stem 142 relative to the valve element 101 upon its engagement against the valve seat 110 for a purpose to be described hereinafter. Diaphragm actuator 114 is normally biased to the position shown, a position at which the valve element 101 is positioned to engage the valve seat 108, by means of a coil spring 152 of predetermined force. As shown, spring 152 abuts at one end against the spring retainer plate 145 and at its opposite end against the web 90, with the spring thus being positioned so as to loosely encircle the boss 93 and the valve stem 142.

A second coil spring 153 of a predetermined force substantially less than that of the coil spring 152 is positioned so as to loosely encircle the lower end of the valve stem 142 and with one end of the spring 153 abutting the lower surface of boss 93 and its opposite end abutting against the valve element 101 whereby to normally bias this valve element in a direction to effect its seating engagement against the valve seat 110.

OPERATION

During operation of the engine 1, the air pump 14 will be continuously operated so as to supply secondary air via conduit 15 and inlet passage 26 to the valve chamber 25 with the output of the air pump being related to engine speed, in the construction shown. With the engine operating, the vacuum chamber 53 will be continuously supplied with a vacuum signal indicative of the engine operating condition.

Thus at cold start vacuum chamber 53 will be supplied with a vacuum signal and since, under a cold start operation the solenoid SOL-V1, which is normally open, would be energized to thus effect movement of its armature valve 77 to a position in abutment against pole 78 blocking flow through passage 78*a* so that pressurized fluid will not be supplied to actuator chamber 54. Accordingly, the actuator chamber 54 at this time will be exposed only to manifold vacuum through the timing orifice notch 67 provided in the switching diaphragm assembly 33.

In addition, during a cold start, the solenoid valve SOL-V2 would have its coil 128 energized to effect movement of its armature valve 126 to a position blocking flow through the passage 122 while permitting fluid communication between the passages 121 and 123. Accordingly, the variable pressure chamber 91 will also receive a corresponding vacuum signal.

Atmospheric pressure in the atmospheric chamber 115 will effect a pressure differential across the diaphragm actuator 114, which acts against the bias of spring 152, to effect movement of diaphragm means 100 downward, with reference to the drawing, so that its valve element 101 will then seat against the valve seat 110.

Accordingly in this cold mode of operation, the valve member 30 would be positioned, as shown, to block flow from the valve chamber 25 into passage 45 while permitting secondary air to flow out through the primary outlet passage 28. Since at this time the valve member 101 is seated against valve seat 110, the secondary air flowing through the primary outlet passage 28 would flow through the openings 111 in the valve member into the compartment 92 and then flow from this compartment out through the exhaust outlet passage 130 to the exhaust manifold 8.

As previously described, the valve stem 142 is provided with a small amount of end play relative to the valve element 101. This end play is provided to allow continued downward axial movement of the valve stem 142 after valve element 101 is seated against the valve seat 110 so that the central portion of the valve actuator 114, that is, the portion extending downward through the spring retainer plate 145, can seat against the valve seat 95. This will prevent any pressurized air in compartment 92 and in the blind chamber 109 from leaking through the clearance space between the valve stem 142 and its guide bore 94 from entering the variable pressure chamber 91 which is then receiving a vacuum signal.

Thus under the normal cold engine mode of operation, secondary air will be delivered to the exhaust manifold 8. However, if a rapid engine deceleration occurs, as manifested by the closing of the throttle plate 6, the vacuum chamber 53 will have a sudden increase in manifold vacuum signal applied thereto which will in turn cause the diaphragm 32 to move upward against the biasing force of spring 55 so as to move the valve member 30 upward off valve seat 50 and into engagement with valve seat 51. This will shut off air flow to the exhaust manifold 8 while permitting air flow out through the converter discharge passage 48 to the converter 11.

This flow of secondary air to the converter 11 will continue only until the pressure in actuator chamber 54 is sufficiently equalized to the pressure in vacuum chamber 53 so as to permit the force of spring 55 to effect movement of the diaphragm 32 to the position shown. As this occurs, the metering valve 30 will again open primary outlet passage 28 and close passage 45. This allows secondary air to again flow to the exhaust manifold 8 in the manner described. As will be apparent, this process would be accomplished in a specified predetermined timing cycle based on the size of the timing orifice notch 67, the volume of the actuator chamber 54, and the force of the biasing spring 55 for a particular engine application.

When the engine 1 and converter 11 are warmed up to their respective predetermined operating temperatures, the engine 1 would then be considered to be operating in a warm mode of operation. As this occurs, both solenoid valves SOL-V1 and SOL-V2 would be deenergized. When the solenoid valve SOL-V1 is deenergized, the armature valve 78 thereof will be moved to the position shown to thus supply the actuator chamber 54 with pressurized fluid in the manner described hereinabove. With only a tiny bleed between the vacuum chamber 53 and the actuator chamber 54, as provided by the timing orifice notch 67, air pump 14 pressure will be maintained in the actuator chamber 54 and manifold vacuum will be maintained in the vacuum chamber 53. This creates a differential pressure across the diaphragm 32 acting against the bias of spring 55 to move valve member against valve seat 51 to block flow to the primary outlet passage 28 and permit flow from the valve chamber through passage 45 for continued flow out through the converter discharge passage, with no interruptions of air flow due to decelerations.

At the same time when the solenoid SOL-V2 is deenergized, its armature valve 126 will move to the position shown, thereby blocking the flow of vacuum signal through passage 121 while interconnecting passages 122 and 123 so that the pressure in the variable pressure chamber 91 will then be atmospheric pressure. Since the force of spring 152 is greater than the force of spring 153 the pressure is shut off due to no further secondary air flow through the primary outlet passage 28 and since there is no differential pressure acting on the diaphragm actuator 114, the bias of spring 152 will cause the diaphragm 100 and therefore the valve element 101 to move upward so that the valve element 101 will again abut against valve seat 108.

With the above elements thus positioned as described, if there is any leakage of secondary air from the valve chamber 25 into the primary outlet passage 28, it will flow into chamber 107 and then from this chamber out through the passage 141 into the pressure relief passage 131 for flow back to the atmosphere in the manner described hereinabove.

If during this warm engine mode of operation, the temperature within the catalytic converter 11 exceed a preselected temperature level, the solenoid SOL-V1 will again be energized. As this occurs, its armature valve 78 will again be moved to a position blocking passage **78*a* so that pressurized fluid is no longer supplied to actuator chamber 54. At this time, actuator chamber 54 will be exposed to the vacuum signal in vacuum chamber 53 via the timing orifice notch 67. As the pressure in the vacuum chamber 53 and actuator chamber 54 approach equalization the bias of spring 55 will again cause the switching diaphragm assembly 33 to move downward causing the valve member to again block flow into the passage 45 while permitting secondary air flow out through the primary outlet passage 28. Secondary air flowing through the primary outlet passage 28 will flow into the chamber 107 and from there via passage 141 into the pressure relief passage 131** for discharge to the atmosphere.

When the temperature in the converter 11 decreases to a predetermined temperature below the preselected high temperature for the converter, solenoid valve SOL-V1 would again be deenergized to again allow the flow of pressurized fluid from the air pump 14 into the actuator chamber 54. This pressurized fluid acting on the lower side of the switching diaphragm assembly 33 will again effect movement of the valve member 30 to a position blocking flow out through the primary outlet passage 28 while permitting flow through the passage 45 whereby the secondary air flow is again directed to the converter 11.

In any mode of engine operation, the pressure relief valve member 135 is operative, especially at high engine speeds, to relieve excess pressure within the valve chamber 25 by directing secondary air flow back to the atmosphere in the manner described hereinabove.

In the embodiment illustrated, the primary failure mode of the subject valve assembly, in the event of failure of the solenoid in the solenoid valve SOL-V1, will result in the flow of secondary air primarily to the converter 11, or partly to the converter 11 and to the atmosphere, if vacuum is lost in the vacuum chamber 53. However, it will be apparent to one skilled in the art, that the above primary failure mode can be reversed, if desired, for the flow of secondary air to the atmosphere simply by making the solenoid SOL-V1 a normally closed valve, rather than normally open as shown and described.

Regardless of the primary failure mode used, the relatively high bias of the spring 152 in the air divert portion of the subject valve assembly, will cause the diaphragm 114 and therefore diaphragm 100 and its associated flat valve 101 to move to the position shown so that secondary air flowing through the primary outlet passage 26 will be directed for discharge via passages 141 and 131 to the atmosphere, in the manner described, if the solenoid of solenoid valve SOL-V2 fails.

Although the solenoid valve SOL-V2 has been shown in the construction illustrated as being a separate solenoid valve, it will be apparent to those skilled in the art, that this valve assembly can be formed integral with the subject valve assembly, as by having it attached to the cover 24 and plumbing it to the variable pressure chamber 91 in a manner similar to that shown, or by having the body 120 thereof formed integral with the upper body 21.

The embodiments of the invention in which an exclusive property or privilege is claimed are defined as follows:

1. A fail safe programmable air pump discharge control valve for an engine comprising:

a switching valve having an inlet connectable with the air pump discharge and having a primary outlet passage, a converter outlet passage connectable to a catalytic converter, and a plug element movable to selectively obstruct and open the primary outlet passage and the converter outlet passage in accord with actuation of motor elements connected to the plug element;

means defining a housing having a passage in communication with the primary outlet, an exhaust passage connectable to the engine exhaust ports to deliver air to said exhaust ports and an air discharge passage to the atmosphere, said housing having a pair of coaxial, facing annular first and second valve seats with said first valve seats encircling said passage;

a flat valve located between said valve seats for selective engagement with one or the other, said valve having an aperture means therethrough;

actuator means selectively operable to seat said valve on said first valve seat or on said second valve seat;

whereby said flat valve in seating engagement with said first valve seat delivers air to the exhaust valve ports and when in seating in engagement with said second valve seat delivers air only to said air discharge passage; and said actuator means including spring means to normally bias said flat valve into seating engagement with said second valve seat.

2. A fail safe programmable air pump discharge control valve adapted to deliver air to the exhaust ports of an engine, a portion of the air pump output comprising:

means defining a passage from an air pump, the passage being adapted for connection to the exhaust ports of an engine, said passage extending through the space defined by an annular valve seat, said means further defining a coaxial aligned annular valve seat facing said first mentioned valve seat and having a blind cavity at its opposite side, a flat valve located between said valve seats for selective seal against one seat or the other, means selectively operable to seat said valve on one seat or an other, said means including a diaphragm extending from the regions of said valve outboard the valve seats to the edges of the passage and forming a seal, said valve having an opening inboard the valve seats and said housing defining an air discharge outboard the first mentioned valve seat.

3. In an engine having an exhaust system and a pump for delivering air to said exhaust system, a diverter valve assembly comprising a housing having a port receiving air from said pump, a first annular valve seat surrounding said port and a second annular valve seat disposed opposite said first valve seat, a diaphragm disposed between said valve seats and dividing said housing into first and second chambers respectively associated with said first and second valve seats, said diaphragm having an opening therethrough and defining an annular valve member surrounding said opening, and an actuator for moving said valve member between a first position in which said valve member engages said first valve seat to obstruct air flow from said port to said first chamber and to allow air to flow from said port through said opening to said second chamber and a second position in which said valve member engages said second valve seat to obstruct air flow through said opening to said second chamber and to allow air to flow from said port to said first chamber, said housing also having an outlet for directing air from one of said chambers to a particular location in said exhaust system when said valve member allows air to flow to said one chamber and an outlet for directing air from the other of said chambers to another location when said valve member allows air to flow to said other chamber.

4. In an engine having an exhaust system and a pump for delivering air to said exhaust system, a diverter valve assembly comprising a housing having a port receiving air from said pump, a first annular valve seat surrounding said port and a second annular valve seat disposed opposite said first valve seat, a diaphragm disposed between said valve seats and dividing said housing into first and second chambers respectively associated with said first and second valve seats, said diaphragm having an opening therethrough and defining an annular valve member surrounding said opening, and an actuator including a stem surrounded by said second valve seat and adapted to move said valve member between a first position in which said valve member engages said first valve seat to obstruct air flow from said port to said first chamber and to allow air to flow from said port through said opening to said second chamber and a second position in which said valve member engages said second valve seat to obstruct air flow through said opening to said second chamber and to allow air to flow from said port to said first chamber, said housing also having an outlet for directing air from one of said chambers to a particular location in said exhaust system when said valve member allows air to flow to said one chamber and an outlet for directing air from the other of said chambers to another location when said valve member allows air to flow to said other chamber, said housing further having a guide supporting said stem and a third valve seat surrounding said guide, said actuator further having a valve surface engaging said third valve seat when said valve member engages said first valve seat to obstruct air flow from said second chamber through said guide when said valve member allows air to flow to said second chamber.

* * * * *